US006288496B1

(12) United States Patent
Suzuki et al.

(10) Patent No.: US 6,288,496 B1
(45) Date of Patent: Sep. 11, 2001

(54) SYSTEM AND METHOD FOR DRIVING ORGANIC EL DEVICES

(75) Inventors: Mitsunari Suzuki; Yoshihiro Saitoh; Yoshio Kaita; Hirotada Furukawa, all of Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/567,069

(22) Filed: May 8, 2000

Related U.S. Application Data

(63) Continuation of application No. PCT/JP99/04837, filed on Sep. 7, 1999.

(30) Foreign Application Priority Data

Sep. 8, 1998 (JP) ..... 10-270524

(51) Int. Cl.[7] ..... G09G 3/10

(52) U.S. Cl. ..... 315/169.3; 315/169.1; 345/102; 345/103

(58) Field of Search ..... 315/169.3, 169.1, 315/169.2; 345/36, 45, 76, 98, 100, 102–104; 313/483, 500

(56) References Cited

U.S. PATENT DOCUMENTS 6,016,037 * 1/2000 Kuribayashi et al. ..... 315/169.3
6,208,083 * 3/2001 Suzuki et al. ..... 315/169.3

FOREIGN PATENT DOCUMENTS 4-251288 9/1992 (JP) .
6-301355 10/1994 (JP) .
9-232074 9/1997 (JP) .
11-95723 4/1999 (JP) .

* cited by examiner

*Primary Examiner*—Haissa Philogene
(74) *Attorney, Agent, or Firm*—Oblon, Spivak, McClelland, Maier & Neustadt, P.C.

(57) ABSTRACT

The invention has for its object to provide an organic EL display driving system and method enabling an organic EL display to be driven with neither a contrast lowering nor a false light emission phenomenon yet in simple construction. The driving system and method drive an organic EL device which comprises at least one set of scanning electrodes and data electrodes arranged in a matrix fashion and an organic material-containing organic layer located between said scanning and data electrodes and taking part in at least a light emission function, with one closed circuit formed through at least one set of electrodes. When the scanning and data electrodes are driven, a given non-selection time is provided between driving one electrode and driving the next electrode.

14 Claims, 8 Drawing Sheets

SYSTEM AND METHOD FOR DRIVING ORGANIC EL DEVICES

This application is a continuation of International PCT application No. PCT/JP99/04837 filed on Sep. 7, 1999

TECHNICAL ART

The present invention relates to a system and method for driving an organic EL display which is constructed using an organic compound and has applications in the fields of information display panels used on audio equipment, automotive measuring instrument panels, displays for displaying moving images and freeze-frame pictures, household electrical appliances, car and bicycle electrical equipment, etc.

BACKGROUND ART

In recent years, an organic EL device has been intensively studied and put to practical use. The organic EL device is basically built up of a tin-doped indium oxide (ITO) or other transparent electrode, a triphenyldiamine (TPD) or other hole transporting layer laminated on the transparent electrode, an organic light emitting layer formed of a fluorescent material such as an aluminum quinolinol complex ($Alq^3$) and laminated thereon, and a metal electrode (electron injecting electrode) provided on the organic light emitting layer and formed of a material having a low work function, for instance, Mg. Such a device now attracts attention as displays for use on household electrical appliances, car and bicycle electric equipment, etc., because a luminance of as high as several hundred to tens of thousands of $cd/m^2$ is obtained at a voltage of about 10V.

Such an organic EL device has a structure wherein an organic layer such as a light emitting layer is sandwiched between a scanning (common line) electrode that usually provides an electron injecting electrode and a data (segment line) electrode that usually provides a hole injecting electrode (transparent electrode), and formed on a transparent (glass) substrate. Electroluminescent displays are generally broken down into a matrix display wherein scanning electrodes and data electrodes are arranged in a matrix form to display information such as images and characters in the form of an assembly of dots (pixels), and a segment display comprising independently provided display units each having predetermined shape and size.

The segment type display may be driven in a static driving mode where the display units are independently driven. For the matrix display, on the other hand, a dynamic driving mode is used, wherein scanning lines and data lines are usually driven in a time division fashion. The dynamic driving mode is classified into two driving modes, one wherein the electron and hole injecting electrodes are driven as scanning and data lines, respectively, and the other wherein the electron and hole injecting electrodes are driven as data and scanning lines, respectively.

The organic EL device may be expressed in terms of an equivalent electrical circuit, as shown in FIG. 8. In FIG. 8, the organic EL device is represented in the form of a parallel circuit comprising a diode element D and a parasitic capacity Cp, and so has a parasitic capacity. Therefore, when organic EL devices are arranged and connected together as shown in FIG. 9 for instance, the respective parasitic capacities of the organic EL devices (pixels) connected to scanning lines are added up. Thus, a time constant is provided by the sum of the parasitic capacities (e.g., EL1+EL4+EL7+ . . . ) and pull-up resistance components connected to those electrodes or resistance components such as on-resistance components of push-pull switching elements when a push-pull circuit is used.

Here, the matrix circuit constructed as shown in FIG. 8 is built up of switching elements SW11 to SW13 for driving scanning lines COM1 to COM3 (connecting them to the ground side or opening them), resistance components R1 to R3 (e.g., push-up resistance components or push-pull resistance components when a push-pull circuit is used) for stabilizing the scanning lines COM1 to COM3 at a given potential (power source potential) when these switching elements SW11 to SW13 are in non-operation (off), organic EL devices (pixels) EL1 to EL9, capacity components of these pixels EL1 to EL9, data lines SEG1 to SEG3 connected to the other ends of the pixels EL1 to EL9, and switching elements SW21 to SW23 for connecting these data lines to the driving power source or ground side.

When matrix circuit is driven in a time division fashion, the scanning electrode COM1 which reaches an L level upon turned on at a time t11 is turned off at a time t12, as shown in FIG. 10 for instance, so that when the scanning line goes back to an H level, there is a delay time $T_d$ due to the time constant defined by the parasitic capacities and the resistance components such as pull-up resistance components. This delay time $T_d$ overlaps the on-time $T_{on}$ of the next scanning line COM2 at the time t12 to tn (t13, t14 . . . ) with the result that although depending on the data line condition, some pixels at the scanning line emits light for this delay time irrespective of being a non-selected pixel.

As shown in FIG. 11 as an example, when eyeing a certain group of pixels on the matrix, a pixel G appears, which gives rise to false light emission halfway between a lighting (driving) pixel L and a non-lighting (non-driving) pixel D or is brighter than in non-light emission state. Such false light emission makes contrast worse or is perceived as anomalous light emission, resulting in considerable drops of the quality of the display or a disturbance factor in images.

The case where electron and hole injecting electrodes are driven as scanning and data lines, respectively, has been explained. However, it is understood that when electron and hole injecting electrodes are driven as data and scanning lines, too, similar phenomena arise.

DISCLOSURE OF THE INVENTION

An object of the present invention is to provide an organic EL display driving system and method which enables an organic EL display to be driven with neither a contrast lowering nor a false light emission phenomenon yet in simple construction.

When the matrix type display is driven, there is a delay time due to CR components in the organic EL device and the driving circuit, as already explained. For this reason, overlapping light emission occurs between a certain driving line and the next driving line, resulting in a contrast lowering and an anomalous light emission phenomenon.

For an organic EL device, it is common to use a driving system for driving the scanning electrode side at a constant voltage. From the pull-up resistance R of a scanning electrode or the on-resistance R of a switching element corresponding to the pull-up resistance when a push-pull circuit is used and the combined capacity C of one scanning line corresponding to the sum of the parasitic capacity of the organic EL device, therefore, the time transition of the scanning electrode from a selected voltage (ground potential) to a non-selected voltage (power source voltage: E) is represented by the following equation:

$$vc = E\left(1 - e^{-\frac{1}{CR}t}\right) \tag{2}$$

The then equivalent circuit is shown in FIG. 12. The voltage value Vc is a transient voltage after a switch SW is turned off at t=0 from the state where it is initially turned on.

Now consider the driving circuit for the organic EL display in further detail. In the matrix circuit of FIG. 9, when a scanning electrode COM2 is driven following COM1, the corresponding pixels EL4 and EL5 are selected and lit on. Here assume that the pixel EL4 is faintly lit up during the selection time for the pixel EL5 (false light emission).

As shown in FIG. 13 where $V_{th}$ signifies the forward threshold voltage of the organic EL device, even when the scanning electrode is in a non-selection state, a current continues to run through the organic EL device EL4 until the voltage applied in the forward direction of the organic EL device EL4 becomes lower than the threshold voltage $V_{th}$. As a result, the device EL4 emits light and so becomes brighter than other non-emitting device (false light emission). This is irrespective of whether data electrodes SEG1 to SEG3 are driven in a constant voltage or current mode. The threshold voltage $V_{th}$ is usually of the order of 2 to 3 V although varying with the construction,. etc. of the organic layers.

Here let E signify the voltage applied in the forward direction of the organic EL device when the device is lit up. From equation (2), a time Tf during which false light emission occurs may be found by $$E - V_{th} = E\left(1 - e^{-\frac{1}{CR}T_f}\right) \tag{3}$$

$$T_f = CR\ln\frac{E}{V_{th}}$$

The waveform of a current then running through the organic EL device EL4 and the voltage waveform of the scanning electrode COM1 are shown in FIG. 13.

In FIG. 13, let S1 signify the time integration of the current flowing through the organic EL device while it emits light and S2 signify the time integration of the current flowing through the organic EL device while false light emission takes place. It is generally known that if the contrast ratio between the emitting and non-emitting portions of a display is at least 100:1, both portions can be clearly distinguished from each other so that high viewability can be obtained. Further, the light emission luminance of an organic EL device is proportional to the density of current flowing therethrough. Therefore, given a determined light emission area, it is then found that the light emission luminance of the device is proportional to the current flowing therethrough.

It follows that if the time integration S1 and S2 of the current flowing through the device with respect to normal light emission time (time T1) and false light emission time (Tf) satisfies the following condition (4), the contrast ratio is at least 100:1 and so comes within an allowable range.

$$S2 \leqq S1/100 \tag{4}$$

Here S1 is $$S_1 = \int_0^{T1} i_1 dt$$

Therefore, S2 may be expressed by $$S_2 = \int_0^{CR\ln\frac{E}{V_{th}}} i_2 dt$$

Here the current i1 is defined by a forward current flowing through the organic EL device and the selection time T1 is defined by 1/ (the number of scanning lines x frame frequency). The "frame" used herein refers to one screen indicated when the scanning lines are driven from the uppermost line (one end) to the lowermost line (the other end). When data electrodes are driven at a constant voltage while the area of one pixel of the organic EL device is a few $mm^2$, an approximate expression i1=I1 where I1 signifies an ideal current waveform of current value may hold, assuming that the rise time delay (dullness) is reduced. Even when the data electrodes are driven at a constant current or voltage, on the other hand, the rise of the current i1 becomes dull if the parasitic capacity of the device is large. In such a case, an approximate value of the area S1 may be obtained from the found value. The current i2 is a current contributing to false light emission, and should preferably be used on the basis of an approximate expression found from the voltage-current characteristics of the organic EL device.

However, such as when the combined capacity C increases with increases in the device area and the number of devices on one scanning line and the resistance components R such as the pull-up resistance of the scanning electrode and the on-resistance of the switching element in the push-pull circuit cannot be reduced, it is impossible to satisfy the condition (4), resulting in a contrast lowering and drops of viewability and image quality.

This can be avoided by providing a time corresponding to the delay time, i.e., a non-selection time during which any of electrodes is not driven, after one line is driven, and then driving the next line, so that overlapping light emission can be prevented and so a contrast lowering and false light emission can be prevented.

The aforesaid object is achieved by the inventions defined below:

(1) An organic EL display driving system for driving an organic EL device which comprises at least one set of scanning electrodes and data electrodes arranged in a matrix fashion and an organic material-containing organic layer located between said scanning and data electrodes and taking part in at least a light emission function, with one closed circuit formed through at least one set of electrodes, wherein:

when said scanning electrodes and said data electrodes are driven, a given non-selection time is provided between driving one electrode and driving the next electrode.

(2) The organic EL display driving system according to (1) above, wherein said non-selection time is provided by finishing driving of the scanning electrode being driven at a given time earlier than a timing of driving the next scanning electrode.

(3) The organic EL display driving system according to (1) above, wherein said non-selection time is provided by delaying the timing of driving the next data electrode by a given time.

(4) The organic EL display driving system according to any one of (1) to (3) above, wherein said non-selection time Toff is a value that satisfies the following condition (1):

$$\int_{T_{off}}^{CR\ln\frac{E}{V_{th}}} i_2 dt \leq \frac{S_1'}{100} \quad (1)$$

where C is the combined capacity of the parasitic capacity of the organic EL device corresponding to one scanning line, R is a scanning line resistance component, E is a scanning line non-selection voltage, Vth is the forward threshold voltage of the organic EL device, Toff is the non-selection time, i2 is a false light emission current, and S1' is the time integration of a light emission current after incorporation of the non-selection time Toff.

(5) The organic EL display driving system according to (4) above, wherein said non-selection time Toff is equal to or less than a false light emission time Tf defined by the following condition (3):

$$E - V_{th} = E\left(1 - e^{-\frac{1}{CR}T_f}\right) \quad (3)$$

$$T_f = CR\ln\frac{E}{V_{th}}$$

(6) The organic EL display driving system according to any one of (1) to (5) above, which comprises display control means for driving said display in a time division mode, and scanning and data electrode driving means for driving said scanning electrode and data electrode of said display in response to a scanning electrode driving signal and a data electrode driving signal from said display control means, said display control means having a given non-selection time between driving one electrode and driving the next electrode.

(7) An organic EL display driving method for driving an organic EL device which comprises at least one set of an scanning electrode and a data electrode arranged in a matrix fashion and an organic material-containing organic layer located between said electrodes and taking part in at least a light emission function, with one closed circuit formed through at least one set of electrodes, wherein:

when said organic EL display is driven, one electrode is driven and the next electrode is then driven at a given non-selection time interval.

(8) The organic EL display driving method according to (7) above, wherein said non-selection time Tooff is a value that satisfies the following condition (1):

$$\int_{T_{off}}^{CR\ln\frac{E}{V_{th}}} i_2 dt \leq \frac{S_1'}{100} \quad (1)$$

where C is the combined capacity of the parasitic capacity of the organic EL device corresponding to one scanning line, R is a scanning line resistance component, E is a scanning line non-selection time, Vth is the forward threshold voltage of the organic EL device, Toff is the non-selection time, i2 is a false light emission current, and S1' is the time integration of a light emission current after incorporation of the non-selection time Toff.

BEST MODE OF CARRYING OUT THE INVENTION

The present invention provides an organic EL display driving system for driving an organic EL device which comprises at least one set of scanning electrodes and data electrodes arranged in a matrix fashion and an organic material-containing organic layer located between said scanning and data electrodes and taking part in at least a light emission function, wherein when said scanning electrodes and said data electrodes are driven, a given non-selection time is provided between driving one electrode and driving the next electrode.

By the provision of the non-selection time, the delay time Td at the line after driven is absorbed within the non-selection time. This in turn makes it possible to prevent a contrast lowering and false light emission without recourse to any special preventive means and equipment.

The non-selection time may be determined in conformity to the time constant found from the resistance components R (resistance such as pull-up/pull-down resistance or on-resistance) in the circuit and the combined capacity of the parasitic capacity of the organic EL device.

That is, the non-selection time Toff should have a value that satisfies the following condition (1):

$$\int_{T_{off}}^{CR\ln\frac{E}{V_{th}}} i_2 dt \leq \frac{S_1'}{100} \tag{1}$$

where C is the combined capacity of the parasitic capacity of the organic EL device corresponding to one scanning line, R is a scanning line resistance component, E is a scanning line non-selection voltage, Vth is the forward threshold voltage of the organic EL device, Toff is the non-selection time, i2 is a false light emission current, and S1' is the time integration of a light emission current after incorporation of the non-selection time Toff.

Figure 13:
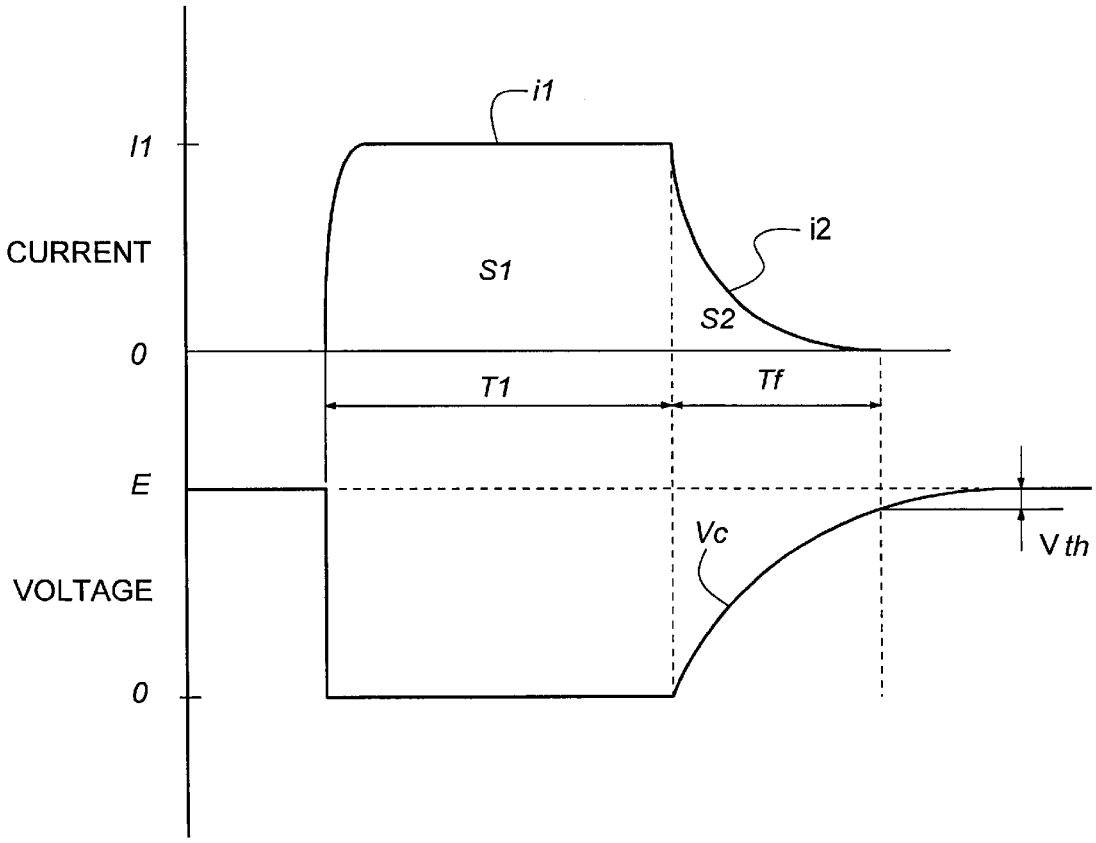
FIG. 13 is a diagram illustrative of the waveform of current flowing through the organic EL device and the voltage waveform of the scanning electrode.

In the above condition, it is noted that when the left side is equal to the right side, the most preferable optimum value is obtained. From the above condition (3), it is found that the maximum value of Toff should preferably be smaller than Tf of FIG. 13, i.e., the time during which false light emission is assumed to take place. When the non-selection time Toff is too long, the display luminance decreases. In consideration of this, it is thus preferable that the optimum non-selection time Toff is determined depending on the balance between the degree of false light emission and the display luminance.

More exactly, the non-selection time is usually of the order of a few tens of ns to several hundred $\mu$s, although varying depending on the type, setting, etc. of the organic EL display used. The non-selection time may be set before or after the turn-on time of the organic EL device. It follows that the non-selection time should preferably be set between driving a certain electrode and driving the next electrode. It is here noted that the action of the non-selection time differs between before or after the turn-on time of the organic EL device, as will be explained just below.

Figure 1:
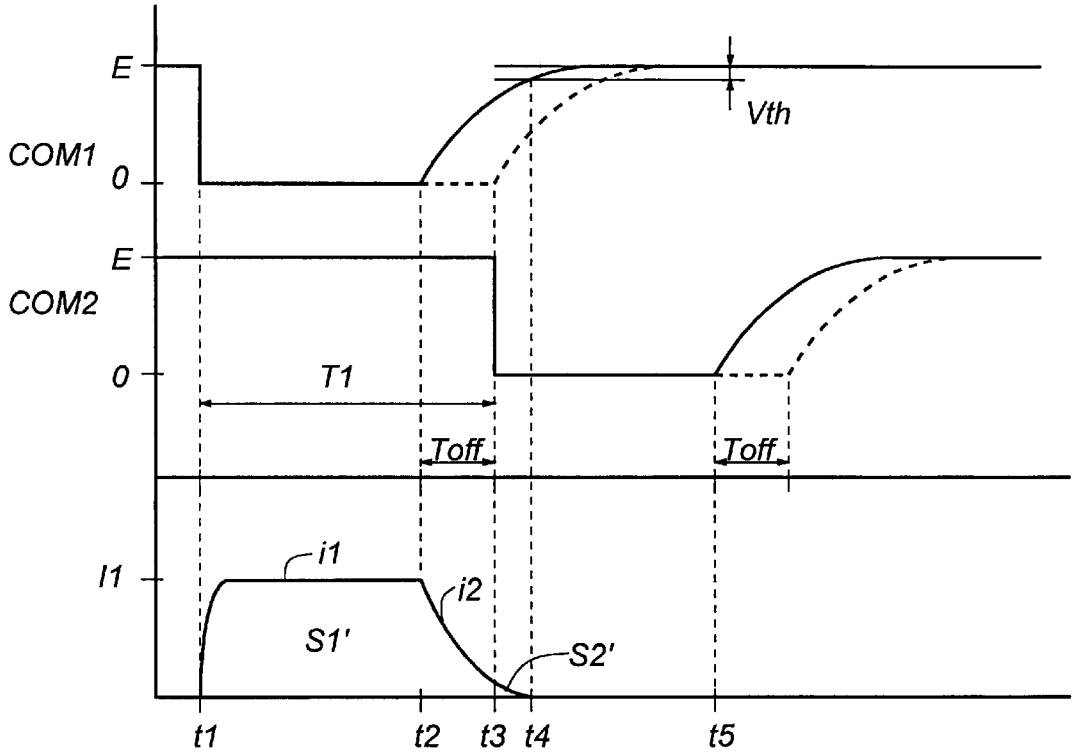
FIG. 1 is a timing chart illustrative of the operation of one organic EL display driving system according to the present invention.

When the non-selection time is set by turning off the electrode (scanning electrode) being driven at a certain time earlier than the turn-on time of the next electrode (scanning electrode), the current passing through the organic EL device to define a certain pixel and the voltage of the scanning electrode have such waveforms as shown in FIG. 1. The waveform indicated by broken lines in FIG. 1 is the voltage waveform before the non-selection time is set. As can be seen from FIG. 1, the non-selection time Toff is set by turning off the electrode COM1 being driven at a certain time earlier than the turn-on time of the next electrode COM2.

In other words, the non-selection time Toff is set between the turn-off timing t2 and the timing t4 at which the threshold voltage $V_{th}$ is reached. The major portion of the current fed during the t2 to t4 period flows during the non-selection time to emit light for the period during which the next electrode is not driven. As a result, it is quite unlikely that this light emission is perceived as false light emission. The value S2' of time integration of the light emission current between the non-selection time finish point t3 overlapping the driving time of the next electrode and the timing t4 at which the threshold voltage Vth is reached becomes very small, as can be seen from FIG. 1. It follows that this light emission is within the permissible range (the contrast ratio of at least 100:1), and so it is quite unlikely to be perceived as false light emission.

That is, the non-selection time Toff is set in FIG. 1, thereby reducing the amount of false light emission or S2' and hence increasing the contrast ratio.

For instance, when it is desired to obtain a contrast ratio of at least 100:1, the non-selection time Toff should satisfy the following relation:

$$S2' \leqq S1'/100$$

Here S1' signifies the time integration of a light emission current after the non-selection time Toff is set and S2' signifies the time integration of a false light emission current after the non-selection time Toff is set. It follows that the non-selection time should meet the following condition (5):

$$\int_{T_{off}}^{CR\ln\frac{E}{V_{th}}} i_2 dt \leq \frac{\int_0^{(T_1-T_{off})} i_1 dt + \int_0^{T_{off}} i_2 dt}{100} \tag{5}$$

Figure 2:
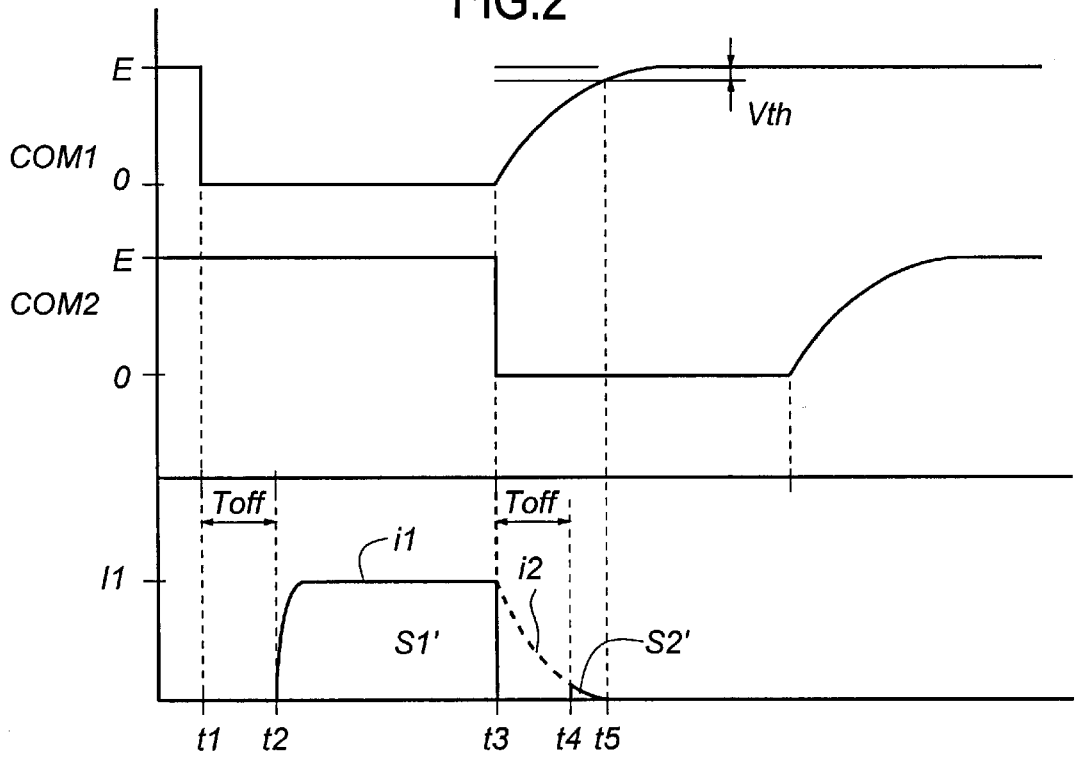
FIG. 2 is a timing chart illustrative of the operation of another organic EL display driving system according to the present invention.

Referring the case where after an electrode (scanning electrode) is driven, the non-selection time is set by turning off an electrode (data electrode) for a constant time when the next electrode is driven, the current passing through the organic EL device to define a certain pixel and the voltage of the scanning electrode have such waveforms as shown in FIG. 2. In this case, the non-selection time Toff is set such that when the scanning electrode COM1 is driven and the next electrode COM2 is thereafter driven, the data electrode (segment) side is turned off to keep the current from flowing through the next electrode COM2 for a certain time.

In this case, the non-selection time Toff is set between the turn-on timing t3 and the timing t5 at which the threshold voltage Vth is reached. The current i2 (indicated by a broken line in FIG. 2) fed before the non-selection time Toff is set does not flow through the organic EL device, and so is unlikely to cause false light emission, because the feeding power source is turned off for the non-selection time Toff. The value S2' of time integration of the light emission current between the non-selection time finish point t4 overlapping the driving time of the next electrode COM2 and the timing t5 at which the threshold voltage Vth is reached becomes very small, as can be seen from FIG. 2.

In FIG. 2, too, the non-selection time Toff is set, thereby reducing the amount of false light emission or S2' and hence increasing the contrast ratio.

For instance, when it is desired to obtain a contrast ratio of 100:1 or less, the non-selection time Toff should again satisfy the following relation:

$$S2' \leqq S1'/100$$

It follows that the non-selection time should meet the following condition (6):

$$\int_{T_{off}}^{CR\ln\frac{E}{V_{th}}} i_2 dt \leq \frac{\int_0^{(T_1-T_{off})} i_1 dt}{100} \tag{6}$$

No particular limitation is imposed on the thus set non-selection time Toff with the proviso that the above condition be satisfied. Usually, however, the non-selection time Toff should be of the order of 10 ns to 1 ms, preferably 1 $\mu$s to 100 $\mu$s, and more preferably 1 $\mu$s to 50 $\mu$s. It is noted that the contrast ratio used herein is not necessarily limited to 100:1. If no problem arises even at 50:1, etc. although depending on the specification, condition, etc. of the display, the value of the denominator of the right side in the above condition (5) or (6) can then be changed from 100 to 50 for instance to obtain the desired contrast ratio.

Usually, the parasitic capacity component is of the order of 0.01 to 100 nF, and especially 1 to 20 nF throughout the pixel corresponding to one scanning line on the matrix portion. The resistance used for such a parasitic capacity range is usually of the order of 1 to $10^5$ Ω, and especially $10^2$ to $10^4$ Ω. The delay time given from these CR components is of the order of $10^{-2}$ to $10^2$ μs.

In the following, the driving system of the present invention is explained in detail.

Figure 3:
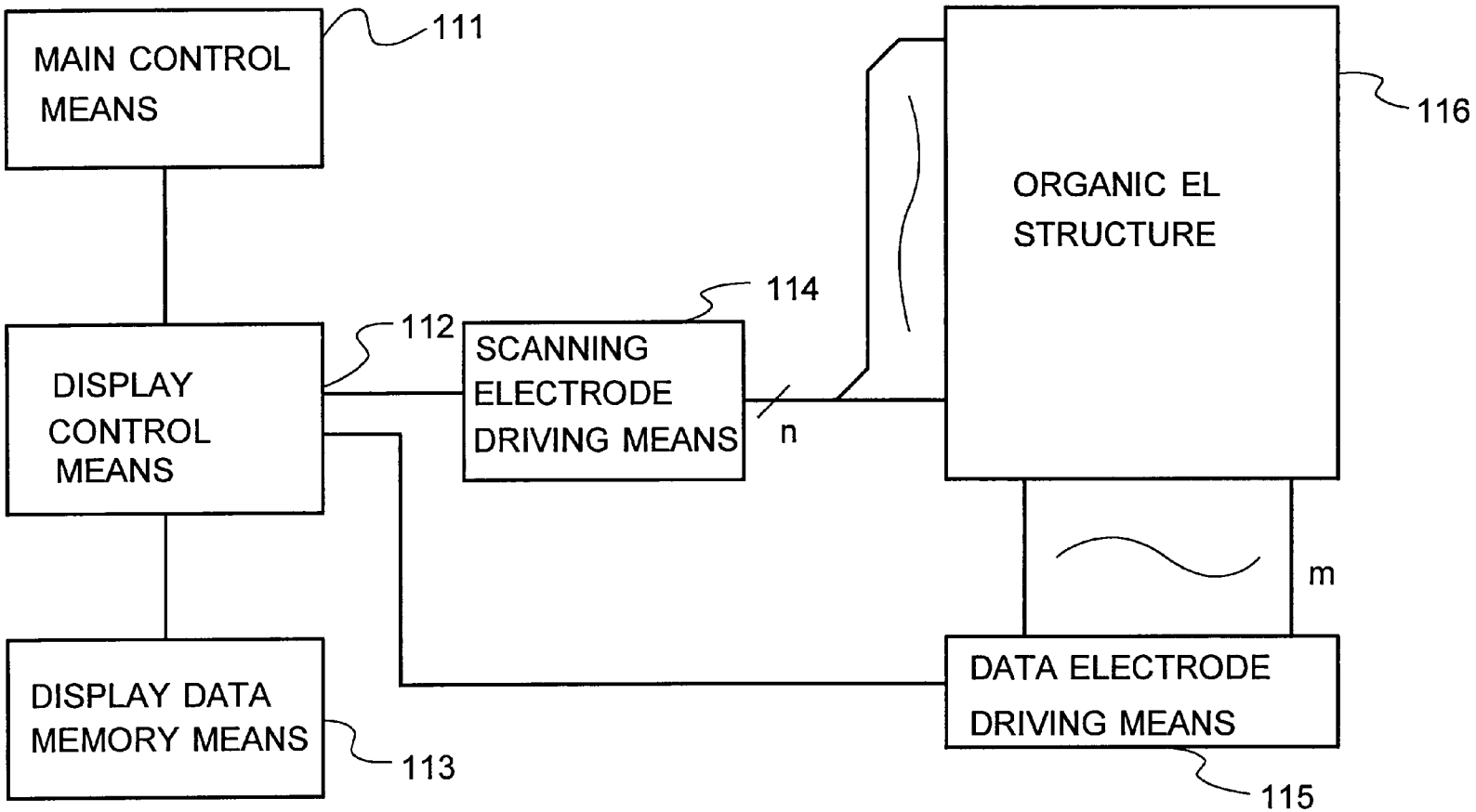
FIG. 3 is a block diagram showing one basic construction of the system for driving an organic EL display according to the present invention.

As shown in FIG. 3 for instance, the driving system of the present invention comprises main control means 111 for providing data to be indicated on a monitor screen and data concerning displays and display control means 112 for sending scanning and data electrode driving signals of the organic EL display in response to display data provided by the main control means 111. The driving system further comprises display data memory means 113 connected to the display control means 112 for storing data for expanding the data provided by the main control means 111, etc. as matrix data, bit map data, etc., predetermined display data and so on, and scanning and data electrode driving means 114 and 115 for driving the scanning and data electrodes of an organic EL structure (an organic EL display unit) 116 in response to scanning and data electrode driving signals from the display control means 112.

The main control means 111 provides the data to be displayed on the organic EL structure 116, designates the display data stored in the display data memory means 113, and provides the timing and control data necessary for display. Usually, this main control means 111 may be built up of a general-purpose microprocessor (MPU), a control algorithm on a memory medium (e.g., ROM, and RAM) connected to the MPU, etc. For the main control means 111, CISCs, RISCs, DSPs, etc. may be used regardless of their processor description. Alternatively, combinations of logic circuits such as ASICs may be used. In this embodiment of the invention, the main control means 111 is independently provided. However, it is understood that the main control means 111 may be integral with the display control means 112, control means of the system in which the display is installed, etc.

The display control means 112 is operable to analyze the display data, etc. provided by the main control means 111, etc., and convert the display data to the matrix data to be displayed at a given position on the organic EL display, if required, after retrieving the data stored in the display data memory means 113. That is, when the image or character data to be displayed are defined by the dot data of pixel units of the organic EL device given by the points of intersection on the matrix, signals are produced, which drive the scanning and data electrodes to provide dot coordinates. The display control means 112 also provides driving in each frame unit, control for the driving ratio (duty) of the scanning and data electrodes, etc.

The display control means provides control such that after one electrode is driven in driving the scanning electrode and the data electrode, the non-selection time is set between driving the one electrode and driving the next electrode. To this end, when a certain scanning electrode is driven as mentioned above, the driving of the scanning electrode is finished at a time earlier than the timing of driving the next scanning electrode by the non-selection time. Alternatively, when a certain electrode is driven following which the next scanning electrode is driven, the associated data electrode may be turned off for a time corresponding to the non-selection time. These may be determined depending on the embodiment of the display control means.

The display control means 112, for instance, may be built up of a processor or composite logic circuit having a given computation function, a buffer for allowing the processor, etc. to give and receive data to and from external main control means, etc., a timing signal generating circuit (oscillation circuit) for giving a timing signal and a display timing signal to a control circuit and giving a read signal, a write signal and so on to external memory means, a memory element control circuit for giving and receiving display data, etc. to and from the external memory means, a driving signal sending circuit for sending display data read out of an external memory element or obtained by processing the display data, and various registers for storing data concerning externally provided display functions and displays to be indicated, control commands, etc.

The display data memory means 113 is loaded therein with data (conversion table) for expanding externally provided image data as matrix data on the display, data with given character image and image date expanded immediately on the matrix data, and is readable or writable by designating the respective loading positions (addresses), if required. For such display data memory means, it is preferable to use semiconductor memory elements such as RAMs (VRAMs) and ROMs. Alternatively, it is also possible to make use of memory medium harnessing light and magnetism.

The scanning and data electrode driving means 114 and 115 drive scanning and data electrodes, respectively, in response to the scanning and data driving signal given thereto from the display control means 112. The organic EL device forming part of the organic display EL display is a light emitting device that gives out light upon current driven. This light emitting device is driven by converting scanning and data driving signals, which are usually provided in the form of voltage signals, to signals having given current values, and applying the signals to given scanning and data electrodes. The data electrode driving current should preferably be of the order of usually 0.001 to 100 mA, and especially 0.01 to 50 mA.

More illustratively, scanning and data electrodes at given positions are driven using a voltage-current converter element, an amplifier element (power amplifier) or the like. For such a driving circuit, for instance, an open drain circuit, an open collector circuit and a push-pull circuit may be used. A possible voltage-current converter or amplifier element is a contacted device such as a relay. In consideration of high-speed and reliable operation, however, it is preferable to make use of transistors, FETs or semiconductor elements equivalent in function thereto. These may also be constructed in the form of an integrated circuit. These semiconductor elements connect the scanning and data electrodes to either one of the power source and ground sides. It is here understood that the "power source side" and "ground side" include not only direct connection to the power source or ground line but also connection thereto via an element such as a current-limiting resistance, a protective device and a regulator.

In the organic EL structure 116, a plurality of scanning electrodes cross over a plurality of data electrodes. With a driving signal given between two arbitrary electrodes of these electrodes, a specific pixel (an organic EL device) emits light. The number of scanning and data electrodes on the matrix portion may be appropriately determined depending on the size and definition of the display. Usually, however, the number of scanning electrodes is of the order of 1 to 768 and the number of data electrodes is of the order of 1 to 1,024.

For the present invention, it is preferable that the non-selection time is set especially when the driving signals for the scanning and data signals are formed in the display control means 112 out of the aforesaid circuit-constituting elements.

The aforesaid circuit is nothing but one example of the circuit construction for driving the organic EL structure (organic EL display unit); other circuit construction may be used provided that it has equivalent functions thereto. Alternatively, the display control means, scanning electrode driving means and data electrode driving means may be harmoniously integrated together, rather than distinctly assembled together. It is here noted that these circuit devices are constructed in the form of one or two or more ICs and their peripheral parts.

Displays driven by the system of the present invention, for instance, are suitably used in the form of indicators for household electrical appliances such as microwave ovens, electric rice cookers, air conditioners, video equipment and audio equipment, various indicators for cars and bicycles such as speed meters, tachometers and navigation systems, and various measuring instruments for airplanes and control towers, etc.

For the display control means, scanning electrode driving means and data electrode driving means, it is preferable to use commercially available ICs and LSIs such as LCD controllers, thermal head drivers and PDP drivers. These LCD controllers, thermal head drivers and PDP drivers may be each built up of an operation circuit or processor comprising a combination of logic circuits and memories such as RAMs and ROMs. However, it is preferable to use a commercially available IC, because it is possible to save development costs and times and so develop products rapidly and at low costs.

The LCD controller driver produces an LCD driving pulse of two or more different signal levels necessary to drive the LCD. This LCD driving pulse has a reference voltage and a plurality of signal levels, which are produced in the form of a combined pulse waveform of the respective levels. The period of the pulse waveform and the signal level may be arbitrarily determined depending on the LCD driving mode (e.g., ½, and ⅓ division mode) and the type of the display (e.g., simple matrix type, and segment type). Therefore, the organic EL display used herein may be selected from those equivalent or approximate to the type of LCD.

However, it is not practical to use such a driving pulse having a plurality of stagewise voltage levels to drive the organic EL device, because the light emission luminance varying with current density. To avoid this, it is preferable to make use of signal conversion means for converting the LCD driving pulse to a signal for the organic EL device. The signal conversion means has one detection level or two or more different detection levels. For instance, the signal conversion means has a plurality of detection levels corresponding to a plurality of signal levels of an LCD driving pulse produced from the LCD driving means, so that the organic EL device driving signal is produced depending on the state of signals detected at the plurality of detection levels.

The organic layers in the organic EL structure (display) used in the present invention are now explained.

The organic EL structure used herein, for instance, comprises a substrate, and at least one set of scanning electrode (electron injecting electrode) and data electrode (hole injecting electrode) provided on the substrate in a matrix fashion. Between these electrodes there are provided a hole injecting and transporting layer and a combined light emitting and electron injecting/transporting layer, each being an organic layer, if required, with a protective layer. In addition, a sealing sheet such as a glass sheet is provided.

The organic EL structure (organic EL device) is built up of the following layers.

The light emitting layer has functions of injecting holes and electrons, transporting them, and recombining holes and electrons to create excitons. For the light emitting layer, it is preferable to use a relatively electronically neutral compound.

The hole injecting and transporting layer has functions of facilitating injection of holes from the hole injecting electrode, providing stable transportation of holes and blocking electrons. The electron injecting and transporting layer has functions of facilitating injection of electrons from the electron injecting and transporting layer, providing stable transportation of electrons and blocking holes. These layers are effective for increasing the number of holes and electrons injected into the light emitting layer and confining holes and electrons therein for optimizing the recombination region to improve light emission efficiency.

No particular limitation is imposed on the thickness of the light emitting layer, the thickness of the hole injecting and transporting layer, and the thickness of the electron injecting and transporting layer. However, these layers should preferably a thickness of the order of usually 5 to 500 nm, and especially 10 to 300 nm although varying depending on formation processes.

The thicknesses of the hole injecting and transporting layer, and the electron injecting and transporting layer are approximately equal to, or range from about 1/10 times to about 10 times as large as, the thickness of the light emitting layer although they depend on the design of the recombination/light emitting region. When the hole or electron injecting and transporting layer is separated into an injecting layer and a transporting layer, it is preferable that the injecting layer is at least 1 nm thick and the transporting layer is at least 1 nm thick. The upper limit to the thickness is usually about 500 nm for the injecting layer and about 500 nm for the transporting layer. The same film thickness is also true of the case where two injecting and transporting layers are provided.

In the organic EL device according to the present invention, the light emitting layer contains a fluorescent material that is a compound capable of emitting light. The fluorescent material used herein, for instance, may be at least one compound selected from compounds such as those disclosed in JP-A 63-264692, e.g., quinacridone, rubrene, and styryl dyes. Use may also be made of quinoline derivatives such as metal complex dyes containing 8-quinolinol or its derivative as ligands, for instance, tris(8-quinolinolato) aluminum, tetraphenylbutadiene, anthracene, perylene, coronene, and 12-phthaloperinone derivatives. Use may further be made of phenylanthracene derivatives disclosed in JP-A 8-12600 (Japanese Patent Application No. 6-110569) and tetraarylethene derivatives disclosed in JP-A 8-12969 (Japanese Patent Application No. 6-114456).

Preferably, the fluorescent compound is used in combination with a host substance capable of emitting light by itself; that is, it is preferable that the fluorescent compound is used as a dopant. In such a case, the content of the fluorescent compound in the light emitting layer is in the range of preferably 0.01 to 20% by weight, and especially 0.1 to 15% by weight. By using the fluorescent compound in combination with the host substance, it is possible to vary the wavelength performance of light emission of the host substance, thereby making light emission possible on a longer wavelength side and, hence, improving the light emission efficiency and stability of the device.

Quinolinolato complexes, and aluminum complexes containing 8-quinolinol or its derivatives as ligands are preferred for the host substance. Such aluminum complexes are typically disclosed in JP-A's 63-264692, 3-255190, 5-70733, 5-258859, 6-215874, etc.

Exemplary aluminum complexes include tris(8-quinolinolato)aluminum, bis(8-quinolinolato)magnesium, bis(benzo{f}-8-quinolinolato)zinc, bis(2-methyl-8-quinolinolato)aluminum oxide, tris(8-quinolinolato)indium, tris(5-methyl-8-quinolinolato)aluminum, 8-quinolinolato-lithium, tris(5-chloro-8-quinolinolato)gallium, bis(5-chloro-8-quinolinolato)calcium, 5,7-dichloro-8-quinolinolato-aluminum, tris(5,7-dibromo-8-hydroxyquinolinolato) aluminum, and poly[zinc(II)-bis(8-hydroxy-5-quinolinyl) methane].

Other preferable host substances include phenylanthracene derivatives disclosed in JP-A 8-12600 (Japanese Patent Application No. 6-110569), tetraarylethene derivatives disclosed in JP-A 8-12969 (Japanese Patent Application No. 6-114456), etc.

In the practice of the present invention, the light emitting layer may also serve as an electron injecting and transporting layer. In this case, it is preferable to use a fluorescent material, e.g., tris(8-quinolinolato)aluminum or the like, which may be provided by evaporation.

If necessary or preferably, the light emitting layer is formed of a mixed layer of at least one compound capable of injecting and transporting holes with at least one compound capable of injecting and transporting electrons. Preferably in this case, a dopant is incorporated in the mixed layer. The content of the dopant compound in the mixed layer is in the range of preferably 0.01 to 20% by weight, and especially 0.1 to 15% by weight.

In the mixed layer with a hopping conduction path available for carriers, each carrier migrates in the polarly prevailing substance, so making the injection of carriers having an opposite polarity unlikely to occur. This leads to an increase in the service life of the device due to less damage to the organic compound. By incorporating the aforesaid dopant in such a mixed layer, it is possible to vary the wavelength performance of light emission that the mixed layer itself possesses, thereby shifting the wavelength of light emission to a longer wavelength side and improving the intensity of light emission, and the stability of the device as well.

The compound capable of injecting and transporting holes and the compound capable of injecting and transporting electrons, both used to form the mixed layer, may be selected from compounds for the injection and transportation of holes and compounds for the injection and transportation of electrons, as will be described later. Especially for the compounds for the injection and transportation of holes, it is preferable to use amine derivatives having strong fluorescence, for instance, hole transporting materials such as triphenyldiamine derivatives, styrylamine derivatives, and amine derivatives having an aromatic fused ring.

For the compounds capable of injecting and transporting electrons, it is preferable to use metal complexes containing quinoline derivatives, especially 8-quinolinol or its derivatives as ligands, in particular, tris(8-quinolinolato) aluminum ($Alq^3$). It is also preferable to use the aforesaid phenylanthracene derivatives, and tetraarylethene derivatives.

For the compounds for the injection and transportation of holes, it is preferable to use amine derivatives having strong fluorescence, for instance, hole transporting materials such as triphenyldiamine derivatives, styrylamine derivatives, and amine derivatives having an aromatic fused ring.

In this case, the ratio of mixing the compound capable of injecting and transporting holes with respect to the compound capable of injecting and transporting electrons is determined while the carrier mobility and carrier density are taken into consideration. In general, however, it is preferred that the weight ratio between the compound capable of injecting and transporting holes and the compound capable of injecting and transporting electrons is of the order of 1/99 to 99/1, particularly 10/90 to 90/10, and more particularly 20/80 to 80/20.

The thickness of the mixed layer should preferably be equal to or larger than the thickness of a single molecular layer, and less than the thickness of the organic compound layer. More specifically, the mixed layer has a thickness of preferably 1 to 100 nm, more preferably 5 to 60 nm, and even more preferably 5 to 50 nm.

Preferably, the mixed layer is formed by co-evaporation where the selected compounds are evaporated from different evaporation sources. When the compounds to be mixed have identical or slightly different vapor pressures (evaporation temperatures), however, they may have previously been mixed together in the same evaporation board for the subsequent evaporation. Preferably, the compounds are uniformly mixed together in the mixed layer. However, the compounds in an archipelagic form may be present in the mixed layer. The light emitting layer may generally be formed at a given thickness by the evaporation of the organic fluorescent substance or coating a dispersion of the organic fluorescent substance in a resin binder.

For the hole injecting and transporting layer, use may be made of various organic compounds as disclosed in JP-A's 63-295695, 2-191694, 3-792, 5-234681, 5-239455, 5-299174, 7-126225, 7-126226 and 8-100172 and EP 0650955A1. Examples are tetraarylbenzidine compounds (triaryldiamine or triphenyl-diamine (TPD)), aromatic tertiary amines, hydrazone derivatives, carbazole derivatives, triazole derivatives, imidazole derivatives, oxadiazole derivatives having an amino group, and polythiophenes. The compounds may be used singly or in combination of two or more. Where two or more such compounds are used, they may be stacked as separate layers, or otherwise mixed.

When the hole injecting and transporting layer is provided as a separate hole injecting layer and a separate hole transporting layer, two or more compounds are selected in a preferable combination from the compounds already mentioned for the hole injecting and transporting layer. In this regard, it is preferable to laminate layers in such an order that a compound layer having a lower ionization potential is disposed contiguous to the hole injecting electrode (ITO, etc.). It is also preferable to use a compound having good thin-film formation capability at the surface of the hole injecting electrode. This order of lamination holds for the provision of two or more hole injecting and transporting layers, and is effective as well for lowering driving voltage and preventing the occurrence of current leakage and the appearance and growth of dark spots. Since deposition by evaporation is utilized for device fabrication, films as thin as about 1 to 10 nm can be formed in a uniform and pinhole-free state, which restrains any change in color tone of emitted light and a drop of efficiency by re-absorption even if a compound having a low ionization potential and absorption in the visible range is used in the hole injecting layer. The hole injecting and transporting layer may be formed by the evaporation of the aforesaid compound as is the case with the light emitting layer.

For the electron injecting and transporting layer, there may be used quinoline derivatives such as organic metal complexes containing 8-quinolinol or its derivatives as ligands, for instance, tris(8-quinolinolato)aluminum ($Alq^3$), oxadiazole derivatives, perylene derivatives, pyridine derivatives, pyrimidine derivatives, quinoxaline derivative, diphenylquinone derivatives, and nitro-substituted fluorene derivatives. The electron injecting and transporting layer may also serve as a light emitting layer. In this case, it is preferable to use tris(8-quinolilato)aluminum, etc. The electron transporting layer may be formed as by evaporation, as is the case with the light emitting layer.

When the electron injecting and transporting layer is provided as a separate hole injecting layer and a separate hole transporting layer, two or more compounds are selected in a preferable combination from the compounds already mentioned for the electron injecting and transporting layer. In this regard, it is preferable to laminate layers in such an order that a compound layer having a larger electron affinity is disposed contiguous to the electron injecting electrode. This order of lamination holds for the provision of two or more electron injecting and transporting layers.

Preferably, the hole injecting and transporting layer, the light emitting layer, and the electron injecting and transporting layer are formed by a vacuum evaporation process because a uniform thin film can then be obtained. With the vacuum evaporation process, it is thus possible to obtain a uniform thin film in an amorphous state or with a grain size of up to 0.2 $\mu$m. A grain size of greater than 0.2 $\mu$m results in non-uniform light emission. To avoid this, it is required to make the driving voltage of the device high. However, this in turn gives rise to some considerable drop of charge injection efficiency.

No particular limitation is imposed on conditions for vacuum evaporation. However, the vacuum evaporation should preferably be carried out at a degree of vacuum of up to $10^{-4}$ Pa and a deposition rate of about 0.01 to 1 nm/sec. Also, the layers should preferably be continuously formed in vacuum, partly because the deposition of impurities on the interface between adjacent layers is avoidable resulting in the achievement of high performance, and partly because the driving voltage of the device can be lowered with elimination of dark spots or no growth of dark spots.

When the layers, each containing a plurality of compounds, are formed by the vacuum evaporation process, it is preferable that co-evaporation is carried out while each board with the compounds charged therein is placed under temperature control.

It is noted that the aforesaid electron injecting and transporting layer and hole injecting and transporting layer may be formed of inorganic layers obtained using inorganic materials such as Si and Ge. In addition to the aforesaid organic layers, the organic EL structure comprises a substrate and non-structural thin films such as a hole injecting electrode and an electron injecting electrode interleaved between the substrate and the organic layers.

The electron injecting electrode is preferably formed of a material having a low work function such as K, Li, Na, Mg, La, Ce, Ca, Sr, Ba, Al, Ag, In, Sn, Zn and Zr each in a pure metal form. To improve the stability of the electron injecting electrode, it is also preferable to use a binary or ternary alloy system containing such metals. For the alloy system, for instance, use may be made of Ag.Mg (Ag: 0.1 to 50 at %), Al.Li (Li: 0.01 to 14 at %), In.Mg (Mg: 50 to 80 at %) and Al.Ca (Ca: 0.01 to 20 at %). In this regard, the electron injecting electrode may be formed by an evaporation or sputtering process.

The electron injecting electrode thin film should preferably have at least a certain thickness enough for injection of electrons; it has a thickness of 0.5 nm or more, preferably 1 nm and more preferably 3 nm or more. Although there is no upper limit to the thickness, it is usually preferable that the upper thickness is of the order of 3 to 500 nm. The electron injecting electrode may be provided thereon with an auxiliary protective electrode.

The evaporation pressure should preferably be between $1\times10^{-8}$ Torr and $1\times10^{-5}$ Torr, and the heating temperature for an evaporation source should preferably be between about 100° C. and about 1,400° C. for a metal material and between about 100° C. and about 500° C. for an organic material.

For the hole injecting electrode, it is preferable to use a transparent or translucent electrode because it is constructed as an electrode out of which emitted light is taken. For the transparent electrode, ITO (tin-doped indium oxide), IZO (zinc-doped indium oxide), ZnO, $SnO_2$, $In_2O_3$ or the like may be used. However, ITO (tin-doped indium oxide) and IZO (zinc-doped indium oxide) are preferred. Usually, ITO contains $In_2O_3$ and SnO in stoichiometric composition; however, the amount of O may deviate slightly therefrom. When transparency is not needed for the hole injecting electrode, the hole injecting electrode may be formed of an opaque material as known in the art.

The hole injecting electrode should preferably have at least a certain thickness enough for injection of holes, and so is of preferably 5 to 500 nm, and more preferably 5 to 300 nm in thickness. Although there is no upper limit to the thickness, it is understood that too large a thickness causes concern about defoliation and too small a thickness arises problems in terms of as-produced film thickness, hole transportation capabilities and resistance value.

The hole injecting electrode layer may formed by an evaporation process or the like. However, preference is given to a sputtering process and especially DC sputtering process.

The electrode on the side out of which light is taken should preferably have a light transmittance of 50% or greater, especially 60% or greater and more especially 70% or greater with respect to light in a light emission wavelength range of usually 350 to 800 nm, and with respect to emitted light in particular. When the light transmittance of the electrode becomes too low, the light emitted from the light emitting layer tends to attenuate, failing to obtain the luminance required for the light-emitting device, because the emitted light is taken out of the electrode on the light-taking side.

After the formation of each layer in the organic EL structure, a protective film may be formed of an inorganic material such as SiOx or an organic material such as Teflon or a chlorine-containing carbon fluoride polymer. The protective film may be transparent or opaque, and has a thickness of the order of 50 to 1,200 nm. The protective film may be formed not only by the aforesaid reactive sputtering process but also by an ordinary sputtering process, an evaporation process, a PECVD process or the like.

The substrate may be provided with a color filter film, fluorescent material-containing color conversion film or dielectric reflecting film for controlling the color of light emission.

The organic EL device according to the present invention is generally of the DC drive type while it may be of the AC or pulse drive type. The applied voltage is usually of the order of 2 to 30 volts.

EXAMPLE

The present invention is explained more specifically with reference to examples.

Example 1

Figure 4:
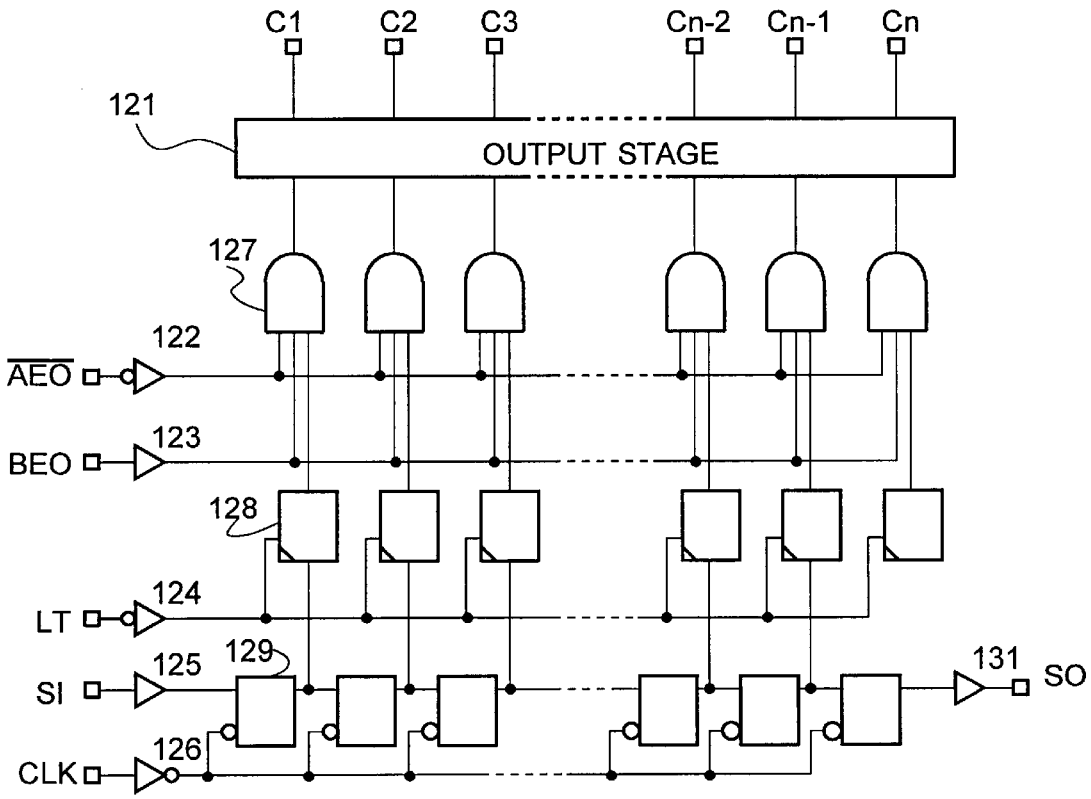
FIG. 4 is a circuit diagram illustrative of the first exemplary arrangement of the organic EL display driving system according to the present invention.

FIG. 4 is a circuit diagram illustrative of the first example of the control means according to the present invention. In this example, a commercially available thermal head driver is used. By use of such a commercial IC, it is possible to save the expense needed for the development and fabrication of ICs and slim down the fabrication cost of the system.

In FIG. 4, data applied to an output stage 121 for driving the organic EL structure are captured from a serial input terminal SI by way of a buffer 125, and serially integrated into each flip-flop 129 in the right direction of the paper in response to a clock signal applied to a clock terminal CLK. It is here noted that this input signal can be fetched from a serial output terminal SO by way of a buffer 125.

The signal captured in each flip-flop 129, if required, may be latched in the flip-flop 128 by a latch signal entered from a latch input terminal LT and applied by way of a buffer 124. In this example, however, this function is not used because the scanning electrode side is driven. The input signal captured in the flip-flop 128 is produced from an AND gate 127 in the form of an AND with respect to an output control signal applied to an output enable terminal AEO (by way of a negative logic input buffer 122) or a BEO (a positive logic input buffer 123). Finally, each scanning electrode C1 to Cn is driven by way of an output (buffer) 121 constructed of a MOS-FET, etc.

In this case, the non-selection time can be set by finishing (turning off) the driving of the output control signal applied to the output enable terminal AEO (negative logic or the BEO (positive logic) at a time earlier by the non-selection time than the time of driving a certain scanning electrode and then driving the next scanning electrode. This operation is shown in FIG. 5.

Figure 5:
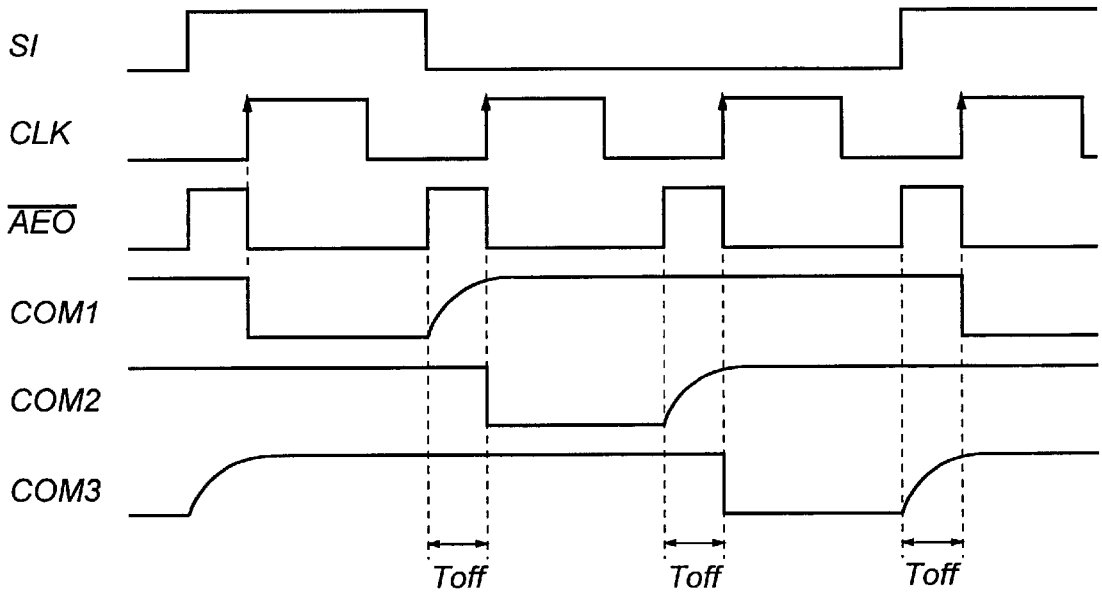
FIG. 5 is a timing chart illustrative of the dynamic waveform for the circuit having the construction shown in FIG. 4.

In FIG. 5, the scanning electrode driving signal SI provides a signal in synchronism with the clock signal CLK. This signal in turn provides an AND with respect to the output control signal AEO (negative logic), and is then produced in the form of a signal for driving each scanning electrode COM1 to COM3. Here the non-selection time is defined by a period during which the output control signal is turned off. Absorbed in this period is the false light emission current period of each scanning electrode driving signal COM1 to COM3.

Example 2

Figure 6:
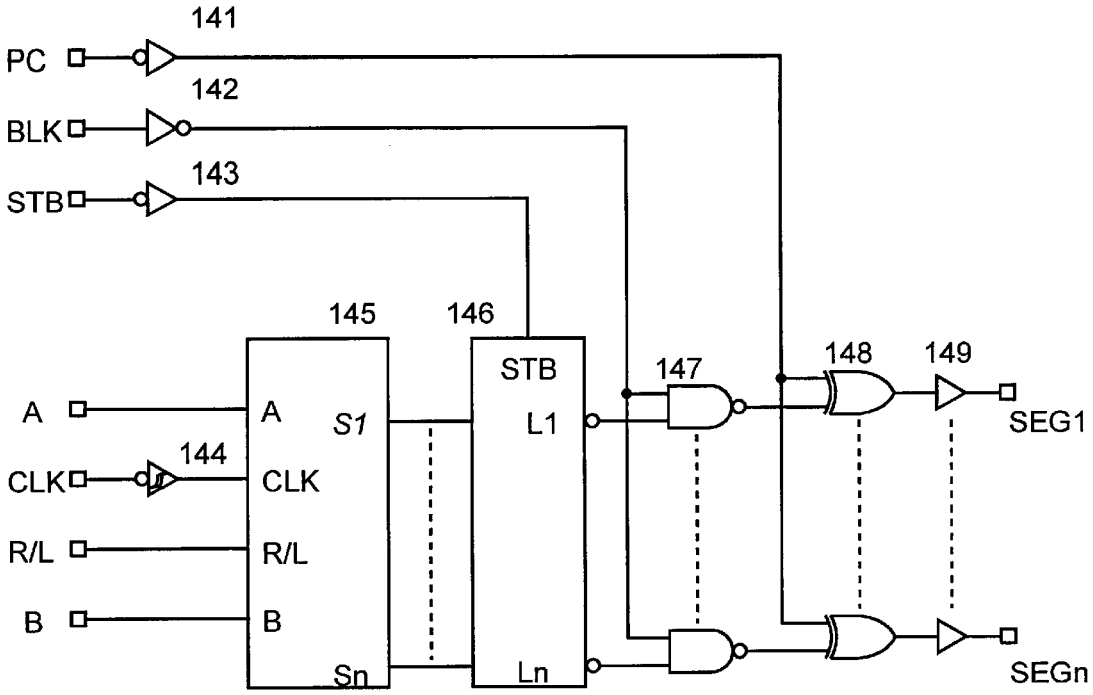
FIG. 6 is a circuit diagram illustrative of the second exemplary arrangement of the organic EL display driving system according to the present invention.

FIG. 6 is a circuit diagram illustrative of the second example of the control means according to the present invention. In this example, a commercially available PDP driver is used. By use of such a commercial IC, it is again possible to save the expense needed for the development and fabrication of ICs and slim down the fabrication cost of the system.

In FIG. 6, data for driving the organic EL structure (data electrode driving signal) are captured in a shift register 145 by way of a serial input terminal A or B. Then, the data appear serially at output terminals in the form of output signals S1 to Sn in synchronism with clocks in response to clock signals applied from a clock terminal CLK by way of a Schmitt inverter 144. It is noted that this shift register 145 enables the direction of shift to be set in response to a signal entered in a direction control terminal R/L.

The output signals S1 to Sn of the shift register 145 are entered in a latch 146 to slue or keep them at terminals L1 to Ln in response to latch signals entered from a latch input terminal STB by way of an inverter 143. Output signals L1 to Ln of the latch 146 are produced from an NAND gate 147 in the form of an NAND with an output control signal applied to the output enable terminal BLK. Then, the produced data are produced from an XOR gate 148 in the form of an XOR with an output control signal applied to an inversion terminal PC. Finally, each data electrode D1 to Dn is thus driven by way of an output buffer 149 constructed of a MOF-FET, etc.

In this case, the non-selection time can be set by disabling (turning off) the driving of the data electrode for the non-selection time at the time of driving a certain scanning electrode and then driving the next scanning electrode. This operation is shown in FIG. 7.

Figure 7:
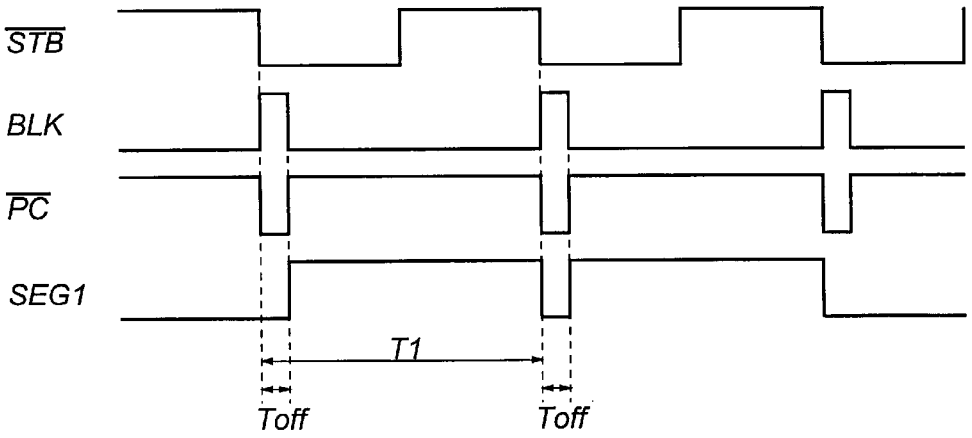
FIG. 7 is a timing chart illustrative of the dynamic waveform of the circuit having the construction shown in FIG. 6.
Figure 8:
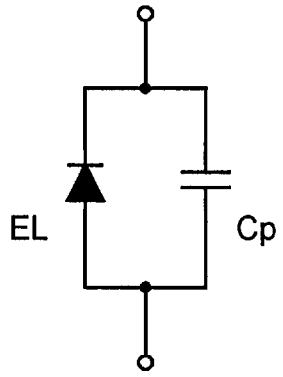
FIG. 8 is an equivalent circuit diagram for the organic EL device.
Figure 9:
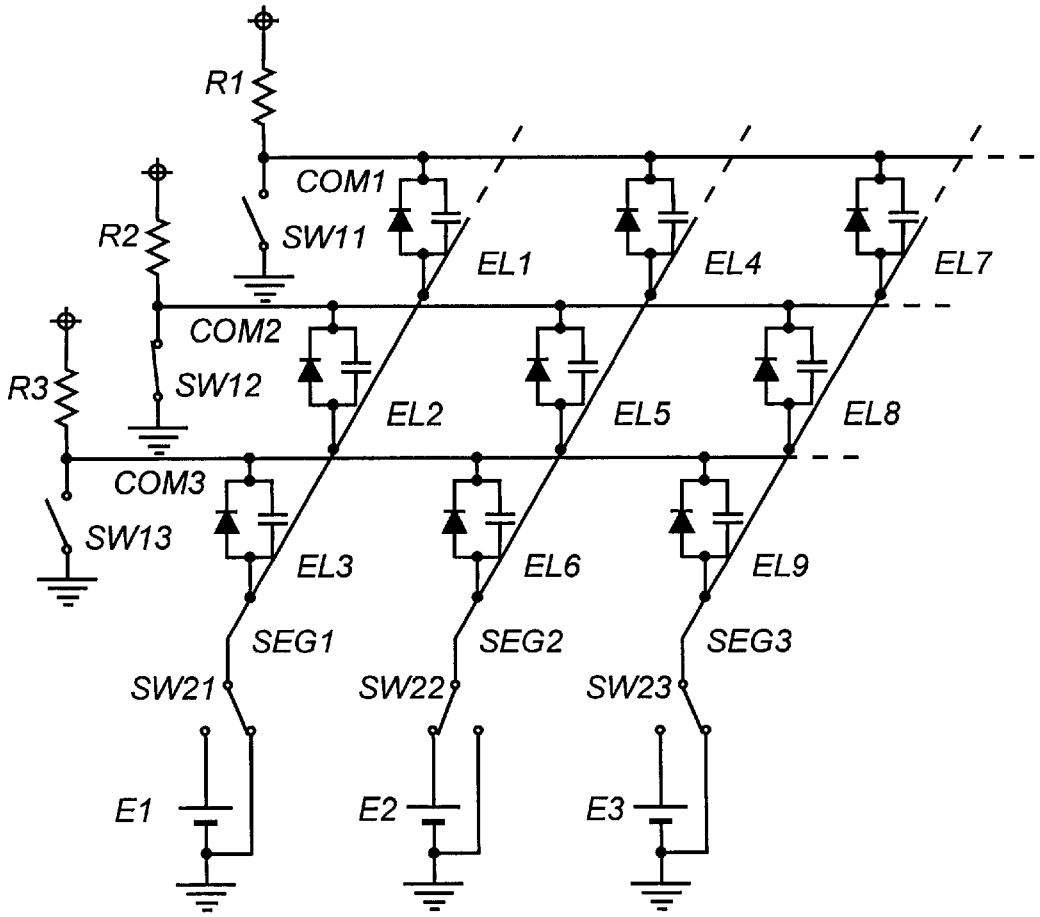
FIG. 9 is a schematic circuit diagram illustrative of one embodiment of the matrix display.
Figure 10:
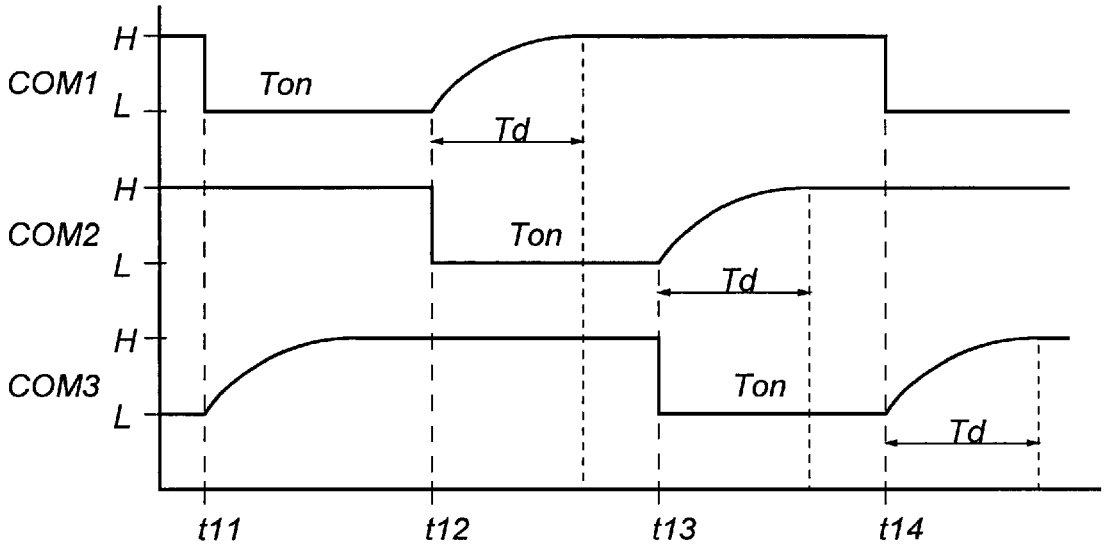
FIG. 10 is a timing chart illustrative of the operating waveform of each scanning electrode in the display of FIG. 9.
Figure 11:
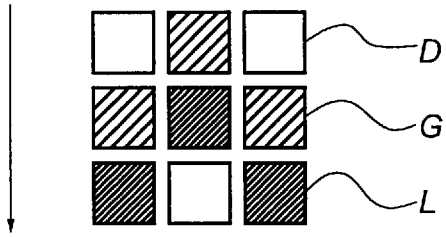
FIG. 11 is a conceptual representation of false light emission in view of a part of the display.
Figure 12:
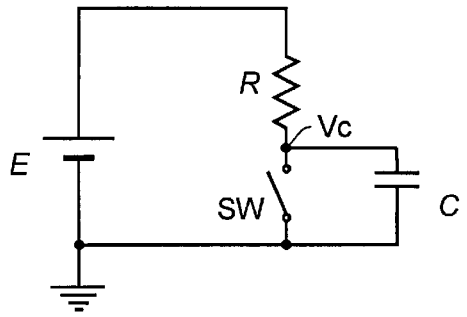
FIG. 12 is an equivalent circuit diagram illustrative of the parasitic capacity and pull-up resistance of the organic EL display corresponding to one scanning electrode line.

In FIG. 7, the data electrode driving signal is entered from an input terminal A or B of the shift register 145 to provide a signal in synchronism with a strobe signal STB.

This in turn provides an NAND with the output control signal BLK (positive logic) and an XOR with an output inversion signal, and they are produced in the form of a signal for driving each data electrode SEG1. Here the non-selection time is defined by a period during which the output control signal BLK is turned off (at an H level) and the output inversion signal PC is turned on (at an L level). Absorbed in this period is the false light emission current period of each scanning electrode driving signal COM1 to COM3.

In this example, circuits, etc. for forming timings of applying scanning and data electrode driving signals and forming scanning and data electrode driving signals according to actually displayed images are omitted. These circuits or circuit elements may be constructed using known display driving circuits, circuit elements, etc.

EFFECT OF THE INVENTION

According to the present invention as explained above, it is possible to achieve an organic EL display driving system and method that enables an organic EL display to be driven with neither a contrast lowering nor a false light emission phenomenon yet in simple construction.

What we claim is:

1. An organic EL display driving system for driving an organic EL device which comprises at least one set of scanning electrodes and data electrodes arranged in a matrix fashion and an organic material-containing organic layer located between said scanning and data electrodes and taking part in at least a light emission function, with one closed circuit formed through at least one set of electrodes, wherein:

when said scanning electrodes and said data electrodes are driven, a given non-selection time is provided between driving one electrode and driving the next electrode.

2. The organic EL display driving system according to claim 1, wherein said non-selection time is provided by finishing driving of the scanning electrode being driven at a given time earlier than the timing of driving the next scanning electrode.

3. The organic EL display driving system according to claim 1, wherein said non-selection time is provided by delaying the timing of driving the next data electrode by a given time.

4. The organic EL display driving system according to claim 1, wherein said non-selection time Toff is a value that satisfies the following condition (1):

$$\int_{T_{off}}^{CR\ln\frac{E}{V_{th}}} i_2 dt \leq \frac{S_1'}{100} \quad (1)$$

where C is the combined capacity of the parasitic capacity of an organic EL device corresponding to one scanning line, R is a scanning line resistance component, E is a scanning line non-selection voltage, Vth is the forward threshold voltage of the organic EL device, Toff is the non-selection time, i2 is a false light emission current, and S1' is the time integration of a light emission current after incorporation of the non-selection time Toff.

5. The organic EL display driving system according to claim 4, wherein said non-selection time Toff is equal to or less than a false light emission time Tf defined by the following condition (3):

$$E - V_{th} = E\left(1 - e^{-\frac{1}{CR}T_f}\right) \quad (3)$$

$$T_f = CR\ln\frac{E}{V_{th}}.$$

6. The organic EL display driving system according to claim 1, which comprises display control means for driving said display in a time division mode, and scanning and data electrode driving means for driving said scanning electrode and data electrode of said display in response to a scanning electrode driving signal and a data electrode driving signal from said display control means, said display control means having a given non-selection time between driving one electrode and driving the next electrode.

7. The organic EL display driving system according to claim 4, which comprises display control means for driving said display in a time division mode, and scanning and data electrode driving means for driving said scanning electrode and data electrode of said display in response to a scanning electrode driving signal and a data electrode driving signal from said display control means.

8. The organic EL display driving system according to claim 5, which comprises display control means for driving said display in a time division mode, and scanning and data electrode driving means for driving said scanning electrode and data electrode of said display in response to a scanning electrode driving signal and a data electrode driving signal from said display control means.

9. The organic EL display driving system according to claim 2, wherein said non-selection time Toff is a value that satisfies the following condition (1):

$$\int_{T_{off}}^{CR\ln\frac{E}{V_{th}}} i_2 dt \leq \frac{S_1'}{100} \quad (1)$$

where C is the combined capacity of the parasitic capacity of an organic EL device corresponding to one scanning line, R is a scanning line resistance component, E is a scanning line non-selection voltage, Vth is the forward threshold voltage of the organic EL device, Toff is the non-selection time, i2 is a false light emission current, and S1' is the time integration of a light emission current after incorporation of the non-selection time Toff.

10. The organic EL display driving system according to claim 3, wherein said non-selection time Toff is a value that satisfies the following condition (1):

$$\int_{T_{off}}^{CR\ln\frac{E}{V_{th}}} i_2 dt \leq \frac{S_1'}{100} \quad (1)$$

where C is the combined capacity of the parasitic capacity of an organic EL device corresponding to one scanning line, R is a scanning line resistance component, E is a scanning line non-selection voltage, Vth is the forward threshold voltage of the organic EL device, Toff is the non-selection time, i2 is a false light emission current, and S1' is the time integration of a light emission current after incorporation of the non-selection time Toff.

11. The organic EL display driving system according to claim 2, which comprises display control means for driving said display in a time division mode, and scanning and data electrode driving means for driving said scanning electrode and data electrode of said display in response to a scanning electrode driving signal and a data electrode driving signal from said display control means.

12. The organic EL display driving system according to claim 3, which comprises display control means for driving said display in a time division mode, and scanning and data electrode driving means for driving said scanning electrode and data electrode of said display in response to a scanning electrode driving signal and a data electrode driving signal from said display control means.

13. An organic EL display driving method for driving an organic EL device which comprises at least one set of an scanning electrode and a data electrode arranged in a matrix fashion and an organic material-containing organic layer located between said electrodes and taking part in at least a light emission function, with one closed circuit formed through at least one set of electrodes, wherein:

when said organic EL display is driven, one electrode is driven and the next electrode is then driven at a given non-selection time interval.

14. The organic EL display driving method according to claim 13, wherein said non-selection time Toff is a value that satisfies the following condition (1):

$$\int_{T_{off}}^{CR\ln\frac{E}{V_{th}}} i_2 dt \leq \frac{S_1'}{100} \quad (1)$$

where C is the combined capacity of the parasitic capacity of an organic EL device corresponding to one scanning line, R is a scanning line resistance component, E is a scanning line non-selection voltage, Vth is the forward threshold voltage of the organic EL device, Toff is the non-selection time, i2 is a false light emission current, and S1' is the time integration of a light emission current after incorporation of the non-selection time Toff.

* * * * *